US008109405B2

(12) United States Patent
Butcher et al.

(10) Patent No.: US 8,109,405 B2
(45) Date of Patent: Feb. 7, 2012

(54) CAN END AND RIVET BASE SCORELINE THEREFOR

(75) Inventors: Gregory H. Butcher, Urbana, OH (US); Greg S. Williams, Wapakoneta, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 187 days.

(21) Appl. No.: 12/137,958

(22) Filed: Jun. 12, 2008

(65) Prior Publication Data

US 2008/0314906 A1 Dec. 25, 2008

Related U.S. Application Data

(60) Provisional application No. 60/945,614, filed on Jun. 22, 2007.

(51) Int. Cl.
*B65D 17/353* (2006.01)

(52) U.S. Cl. ..... 220/271; 220/273

(58) Field of Classification Search ..... 220/269–273
See application file for complete search history.

(56) References Cited

U.S. PATENT DOCUMENTS

| | | | | |
|---|---|---|---|---|
| 3,208,628 | A | 9/1965 | Henchert | |
| 3,334,777 | A | 8/1967 | Smyth | |
| 3,606,076 | A * | 9/1971 | Hanke et al. | 220/273 |
| 3,655,091 | A * | 4/1972 | La Croce | 220/270 |
| 3,724,709 | A * | 4/1973 | Westphal | 220/273 |
| 3,768,692 | A * | 10/1973 | Saunders | 220/273 |
| 3,838,788 | A | 10/1974 | Stargell | |
| 3,863,801 | A * | 2/1975 | Pillnik | 220/267 |
| 3,915,334 | A | 10/1975 | Patel | |
| 3,929,252 | A * | 12/1975 | La Croce | 220/269 |
| 3,951,299 | A | 4/1976 | Khoury | |
| 3,989,161 | A * | 11/1976 | Pillnik | 220/273 |
| 4,002,262 | A * | 1/1977 | Khoury | 220/271 |

(Continued)

FOREIGN PATENT DOCUMENTS

EP 1052039 A1 11/2000

OTHER PUBLICATIONS

Written Opinion issued in International Application No. PCT/US08/66698.

(Continued)

*Primary Examiner* — J. Gregory Pickett
*Assistant Examiner* — Ned A Walker
(74) *Attorney, Agent, or Firm* — Eckert Seamans et al.; Grant E. Coffield, Esquire

(57) ABSTRACT

A can end is provided, which includes a severable panel, a peripheral scoreline defining the periphery of the severable panel, an opening mechanism such as a pull tab, a rivet coupling the pull tab to the severable panel, and a rivet base scoreline in the public side of the severable panel within about 0.025 inch or less of the stem of the rivet. The rivet base scoreline includes an arcuate head portion, first and second arm portions extending from the arcuate head portion, and first and second ends. The base of the rivet has a radius of curvature forming an intersection between the stem of the rivet and the public side of the severable panel. The arcuate head portion of the rivet base scoreline is contiguous with the radius of curvature. The pull tab includes a nose portion having a number of apertures aligned with corresponding portions of the rivet base scoreline disposed thereunder.

9 Claims, 8 Drawing Sheets

U.S. PATENT DOCUMENTS

| | | | | | |
|---|---|---|---|---|---|
| 4,014,455 | A | * | 3/1977 | LaCroce | 220/269 |
| 4,043,479 | A | * | 8/1977 | Khoury | 220/271 |
| 4,044,915 | A | | 8/1977 | LaCroce et al. | |
| 4,096,967 | A | * | 6/1978 | Kaminski | 220/269 |
| 4,146,149 | A | * | 3/1979 | Beveridge | 220/271 |
| 4,182,460 | A | * | 1/1980 | Holk et al. | 220/271 |
| 4,386,713 | A | * | 6/1983 | Baumeyer et al. | 220/269 |
| 4,416,390 | A | * | 11/1983 | Takeda et al. | 220/273 |
| 4,417,668 | A | * | 11/1983 | Stolle | 220/269 |
| 4,804,106 | A | | 2/1989 | Saunders | |
| 4,848,623 | A | * | 7/1989 | Saunders et al. | 220/273 |
| D307,720 | S | | 5/1990 | Saunders et al. | |
| D312,404 | S | | 11/1990 | Bray et al. | |
| 5,038,956 | A | * | 8/1991 | Saunders | 220/271 |
| 5,052,573 | A | * | 10/1991 | Zysset | 220/271 |
| D328,032 | S | | 7/1992 | Saunders et al. | |
| 5,217,134 | A | | 6/1993 | Saunders | |
| 5,232,114 | A | * | 8/1993 | Zysset | 220/273 |
| 5,252,019 | A | | 10/1993 | Saunders et al. | |
| 5,328,313 | A | | 7/1994 | Saunders | |
| 5,462,396 | A | * | 10/1995 | Saunders | 413/67 |
| D382,481 | S | | 8/1997 | McEldowney | |
| 5,688,094 | A | * | 11/1997 | Saunders | 413/67 |
| D396,635 | S | | 8/1998 | McEldowney | |
| D397,296 | S | | 8/1998 | McEldowney et al. | |
| D402,555 | S | | 12/1998 | McEldowney et al. | |
| 5,875,911 | A | | 3/1999 | McEldowney | |
| D422,911 | S | | 4/2000 | Huang | |
| 6,050,440 | A | * | 4/2000 | McEldowney | 220/269 |
| D425,419 | S | | 5/2000 | Huang | |
| 7,270,246 | B2 | | 9/2007 | Butcher et al. | |
| 2002/0014489 | A1 | * | 2/2002 | Anthony et al. | 220/271 |
| 2004/0056032 | A1 | * | 3/2004 | Vaughan | 220/269 |
| 2004/0099665 | A1 | * | 5/2004 | McEldowney et al. | 220/270 |
| 2006/0039780 | A1 | * | 2/2006 | Butcher et al. | 413/67 |
| 2007/0039961 | A1 | * | 2/2007 | McEldowney et al. | 220/269 |
| 2007/0218194 | A1 | * | 9/2007 | Carstens et al. | 427/140 |
| 2007/0278230 | A1 | * | 12/2007 | McEldowney et al. | 220/269 |
| 2008/0014050 | A1 | * | 1/2008 | Butcher et al. | 413/67 |
| 2008/0078764 | A1 | * | 4/2008 | McEldowney et al. | 220/269 |

OTHER PUBLICATIONS

Extended European Search Report Communication dated Aug. 7, 2011.

* cited by examiner

CAN END AND RIVET BASE SCORELINE THEREFOR

CROSS-REFERENCE TO RELATED APPLICATION

This application claims the benefit of U.S. Provisional Patent Application Ser. No. 60/945,614, filed Jun. 22, 2007.

BACKGROUND OF THE INVENTION

1. Field of the Invention

The invention relates generally to containers and, more particularly, to cans ends. The invention also relates to methods of making can ends.

2. Background Information

Many metallic containers for holding products (e.g., without limitation, food; beverages) are sometimes provided with an easy open end, wherein a pull tab is attached to a tear strip or panel that is defined by a scoreline. The pull tab may be lifted and then pulled to provide an opening for dispensing the contents of the container.

FIGS. 1 and 2 illustrate a conventional can end 1 as disclosed, for example, in U.S. Pat. No. 5,038,956. The can end 1 includes a recessed panel 3 defined by a generally vertical chuckwall 5, which surrounds the periphery of the panel 3. FIG. 1 shows the exterior (i.e., public) side 7 of the can end 1, whereas FIG. 2 shows the interior (i.e., product) side 9. A peripheral scoreline 11 (FIG. 1), which is disposed at or about the base of the chuckwall 5, defines an opening section 13 that is intended to be drawn away or removed from the can end 1 to provide access to the contents of the container (e.g., can) (not shown) to which it is attached. To facilitate rupture of the peripheral scoreline 11, an opening mechanism such as, for example, the pull tab 15 shown in FIG. 1, is coupled to the panel 3. More specifically, the pull tab 15 is typically riveted to the opening section 13 of the panel 3 by a rivet 17. A finger well 19 is sometimes included to enable the end user to reach beneath the pull tab 15 to initiate rotation thereof.

As shown in FIG. 2, in an effort to enhance the openability of the can end 1, some can ends 1 include a back scoreline 21 disposed inboard (i.e., toward the center of the can end 1) of the rivet 17 on the product side 9 of the can end 1. The back scoreline 21 is structured to facilitate initial rupture of the peripheral scoreline 11 (FIG. 1) that defines the opening section 13, and to avoid the pull tab 15 (FIG. 1) being accidentally torn off of the panel 3 during the can opening process. The back scoreline 21 of FIG. 2 is arch-shaped and includes an arcuate portion 23 and two substantially straight legs 25,27 extending outwardly away from the arcuate portion 23 toward a safety fold 29 that is contiguous with the base of the chuckwall 5. Thus, it will be appreciated that the can end 1 is a "panel safe" can end 1, meaning that the peripheral safety fold 29 remains with the panel 3, and is structured to shield any raw-edge residual metal remaining with the panel 3 when it is removed from the can end 1.

Scorelines, such as the arch-shaped back scoreline 21 of FIG. 2, suffer from a number of disadvantages. Among them is the fact that the arcuate portion 23 of the back scoreline 21 is disposed inboard of the rivet 17 a relatively significant distance 31 (e.g., at least about 0.03 inches). The position and geometry of the scoreline (e.g., 21) directly affect the opening mechanics of the can end 1. Additionally, as shown in FIG. 2, the example back scoreline 21 is disposed on the product side 9 of the panel 3. This increases the possibility of contamination of the product, for example, due to corrosion or oxidation of the scoreline 21. At a minimum, when using a relatively rigid container material (e.g., without limitation, steel) that oxidizes, the product side back scoreline 21 mandates a post score coating protection operation to coat the product side 9 of the panel 3 and, in particular, the back scoreline 21 thereof, in order to resist oxidation.

There is, therefore, room for improvement in can ends, and in methods of making can ends.

SUMMARY OF THE INVENTION

These needs and others are met by embodiments of the invention, which are directed to a can end (e.g., easy open can end) having a rivet base scoreline structured to improve the opening mechanics (e.g., without limitation, reduce pop and pull forces) of the can end, in order to provide the end user with increased opening convenience, without sacrificing the ability of the can end to withstand scoreline abuse commonly experience, for example, from shipping, corrosion or any other forces common to easy open can ends.

As one aspect of the invention, a can end is provided, which is structured to be affixed to a can body. The can end comprises: a severable panel having a product side structured to face toward the can body when the can end is affixed to the can body, and a public side structured to face away from the can body when the can end is affixed to the can body; a peripheral scoreline defining the periphery of the severable panel; an opening mechanism coupled to the severable panel, the opening mechanism being actuatable to sever the peripheral scoreline; a rivet coupling the opening mechanism to the severable panel, the rivet having a base disposed at the severable panel and a stem extending outwardly from the severable panel; and a rivet base scoreline in the public side of the severable panel. The rivet base scoreline is disposed about 0.025 inch or less from the stem of the rivet.

The severable panel may have an interior, and the rivet base scoreline may include an arcuate head portion, first and second arm portions extending from the arcuate head portion and first and second ends. The rivet may have an inboard side facing the interior of the severable panel, and an outboard side facing the periphery of the severable panel. The arcuate head portion of rivet base scoreline may be disposed on the inboard side of the rivet. The first and second arm portions of the rivet base scoreline may generally extend toward the outboard side of the rivet. The base of the rivet may have a radius of curvature, wherein the radius of curvature forms an intersection between the stem of the rivet and the public side of the severable panel. The arcuate head portion of the rivet base scoreline may be contiguous with the radius of curvature of the base of the rivet.

The opening mechanism may be a pull tab including a nose and a lift portion disposed opposite and distal from the nose. The rivet may have a diameter and a centerline. The pull tab may have a dimension, X, measured by the distance between the nose of the pull tab and the centerline of the rivet, and a dimension, Y, measured by the total length of the pull tab between the nose of the pull tab and the lift portion of the pull tab. In one non-limiting embodiment, the ratio X/Y may be about 0.20 or less, and the diameter of the stem of the rivet may be about 0.1875 inch or less.

The arcuate head portion of the rivet base scoreline may have a first radius of curvature, and the first and second arm portions of the rivet base scoreline may have a second radius of curvature. The first radius of curvature of the arcuate head portion may be the same as the second radius of curvature of the arm portions. The first and second arm portions of the rivet base scoreline may extend beyond the outboard side of the rivet toward the periphery of the severable panel, and the first and second ends of the rivet base scoreline may curve back away from the periphery of the severable panel.

The opening mechanism may have a longitudinal axis. Upon actuation of the opening mechanism, the rivet base scoreline is structured to propagate toward the peripheral scoreline of the can end, thereby defining a bend axis. The bend axis may extend generally perpendicularly with respect to the longitudinal axis of the opening mechanism, and may be disposed between the outboard side of the rivet and the peripheral scoreline proximate to the peripheral scoreline. The opening mechanism may be structured to be lifted, pivoted to a substantially inverted position and pulled, in order to remove the severable panel. Responsive to being lifted, the opening mechanism may be structured to initially sever the peripheral scoreline and, responsive to being pivoted to the substantially inverted position, the opening mechanism may be structured to sever at least 40 percent of the peripheral scoreline.

The opening mechanism may be a pull tab. The pull tab may include a nose portion and a lift portion disposed opposite the nose portion. The nose portion of the pull tab may overlay at least a portion of the rivet base scoreline, and may include a number of apertures structured to be aligned with corresponding portions of the rivet base scoreline thereunder.

As another aspect of the invention, a method of making a can end is provided. The method comprises: forming a rivet on a panel portion of the can end, the panel portion having a public side and a product side, the rivet including a base disposed on the public side of the panel portion and a stem extending outwardly from the public side of the panel portion; and scoring the public side of the panel portion to form a rivet base scoreline, the rivet base scoreline being disposed about 0.025 inch or less from the stem of the rivet.

The method may further comprise: forming a pull tab including a nose portion and a lift portion disposed opposite the nose portion, the nose portion including a rivet hole and a number of apertures disposed proximate to the rivet hole, sliding the nose portion of the pull tab over the stem of the rivet in order that the stem of the rivet is disposed in the rivet hole of the nose portion, and aligning the number of apertures of the nose portion of the pull tab with corresponding portions of the rivet base scoreline thereunder. The method may further comprise applying a post score repair agent to the can end, the repair agent being received through the number of apertures of the nose portion of the pull tab, in order to coat the rivet base scoreline.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
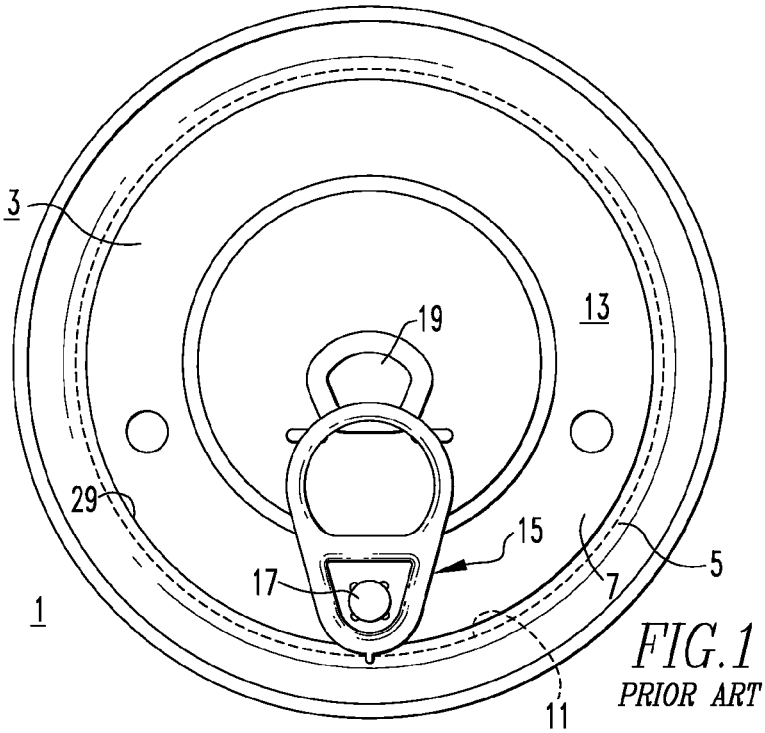
FIG.1 PRIOR ART
FIG. 1 is a top plan view of the public side of a can end.

For purposes of illustration, embodiments of the invention will be shown and described as applied to a circular can end having a safety fold, although it will become apparent that they could also be applied to enhance the opening mechanics of any known or suitable type of container end (e.g., without limitation, circular can ends with an alternative number and/or configuration of safety folds; standard can ends without a safety fold; non-circular can ends with or without a safety fold) made from any suitable material (e.g., without limitation, a suitable metallic material such as aluminum or steel).

Directional phrases used herein such as, for example, clockwise, counterclockwise, up, down, top, bottom and derivatives thereof, relate to the orientation of the elements shown in the drawings and are not limiting upon the claims unless expressly recited therein.

As employed herein, the statement that two or more parts are "coupled" together shall mean that the parts are joined together either directly or joined through one or more intermediate parts.

As employed herein, the term "can" refers to any known or suitable container, which is structured to contain a substance (e.g., without limitation, liquid; food; any other suitable substance), and expressly includes, but is not limited to, beverage cans, such as beer and soda cans, as well as food cans.

As employed herein, the term "can end" refers to the closure that is structured to be coupled to the can, in order to seal the can.

As employed herein, the term "can end shell" is used substantially interchangeably with the term "can end." The "can end shell" or simply the "shell" is the member that is acted upon and is converted by a suitable tooling assembly within a conversion press in order to provide the desired can end.

As employed herein, the term "repair agent" refers to a liquid, lacquer or other suitable coating (e.g., without limitation, sealant), which is applied to the can end after it has been scored, in order to cover and protect (e.g., seal) the scoreline(s) of the can end.

As employed herein, the term "number" shall mean one or an integer greater than one (i.e., a plurality).

Figure 3A:
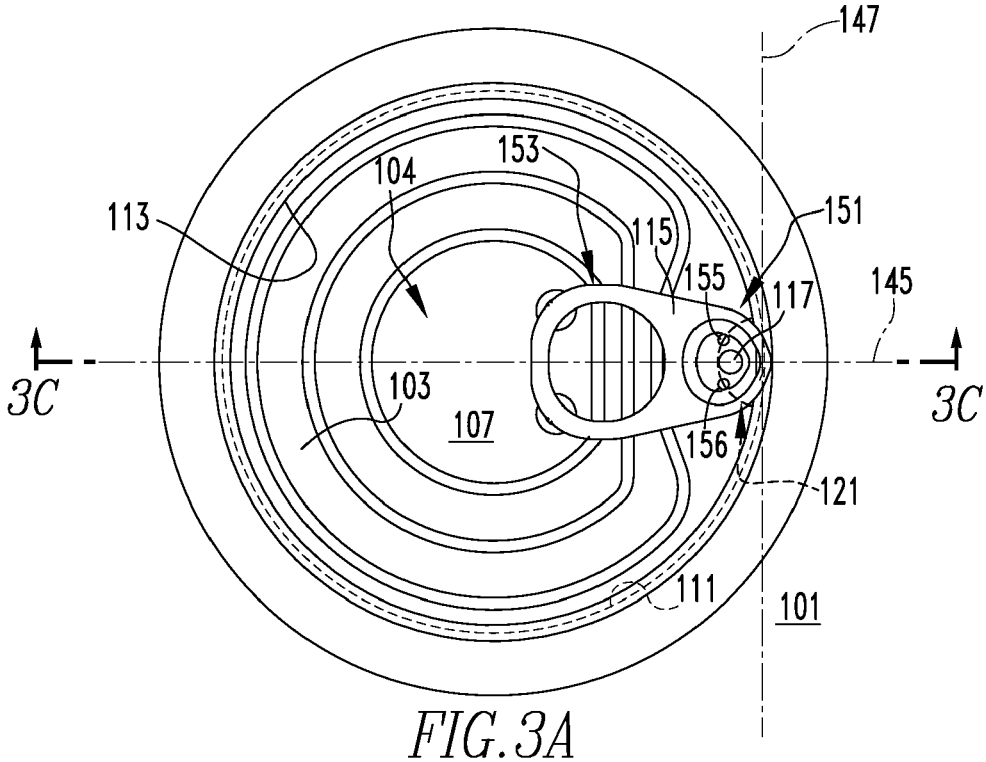
FIG. 3A is a top plan view of the public side of a can end and rivet base scoreline therefor, in accordance with an embodiment of the invention.
Figure 9A:
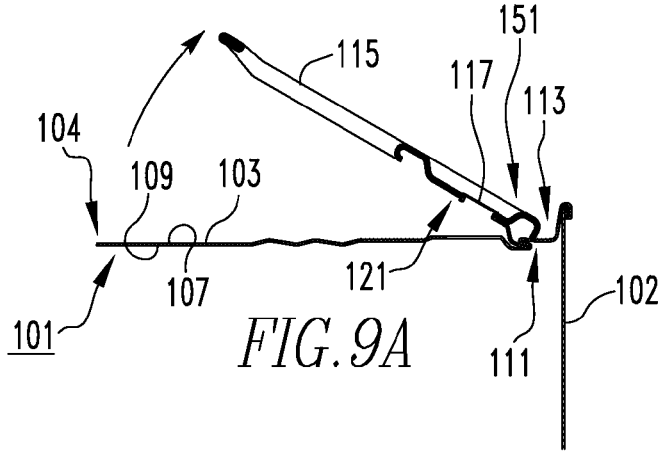
FIGS. 9A-9C are side elevation views showing a can end opening sequence in accordance with an embodiment of the invention.
Figure 9B:
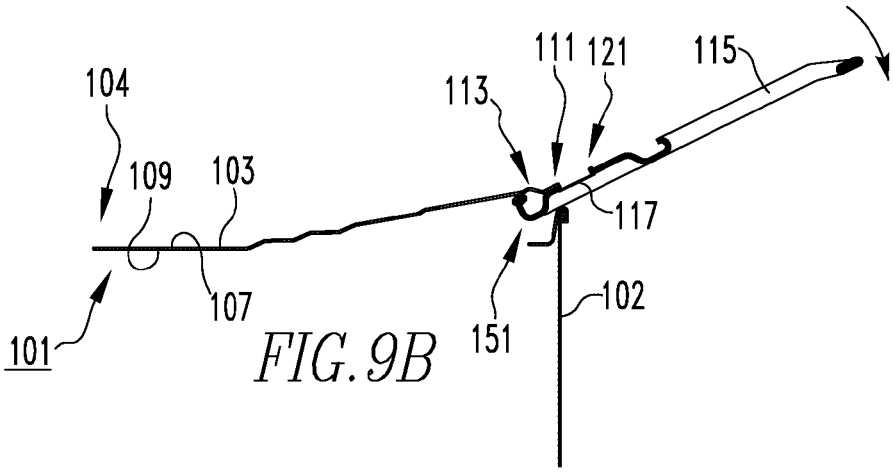
Figure 9C:
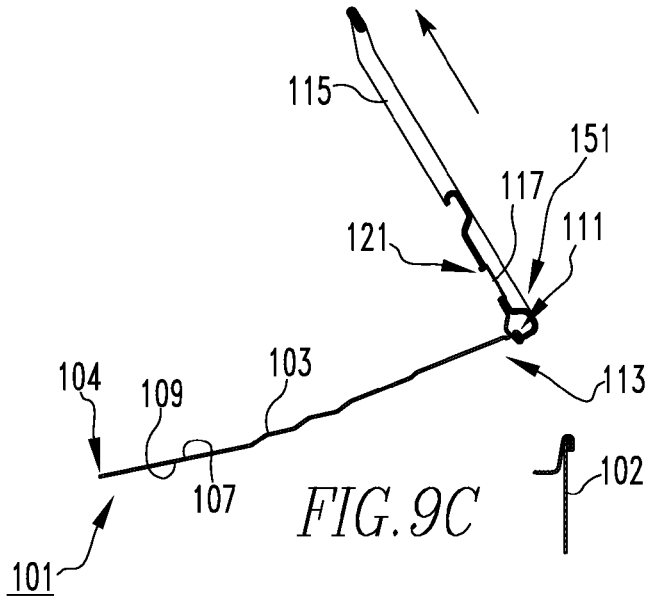

FIG. 3A shows a can end 101, which is structured to be affixed to a can body 102 (partially shown in FIGS. 9A-9C). The can end 101 includes a severable panel 103 having a public side 107 and a product side 109 (FIGS. 3C, 3D and 9A-9C). The product side 109 is structured to face toward the can body 102 when the can end 101 is affixed to the can body 102, and the public side 107 is structured to face away from the can body 102 when the can end 101 is affixed to the can body 102, as shown in FIGS. 9A-9C.

A peripheral scoreline 111 on the public side 107 of the can end 101 defines the periphery 113 of the severable panel 103. An opening mechanism, such as the pull tab 115 which is shown, is coupled to the severable panel 103, and is actuatable to sever the peripheral scoreline 111, as will be described hereinbelow. A rivet 117 couples the pull tab 115 to the severable panel 103. The rivet 117 includes a base 119 disposed at the severable panel 103, and a stem 120 extending outwardly from the severable panel 103, as shown in FIGS. 3C and 3D.

Figure 2:
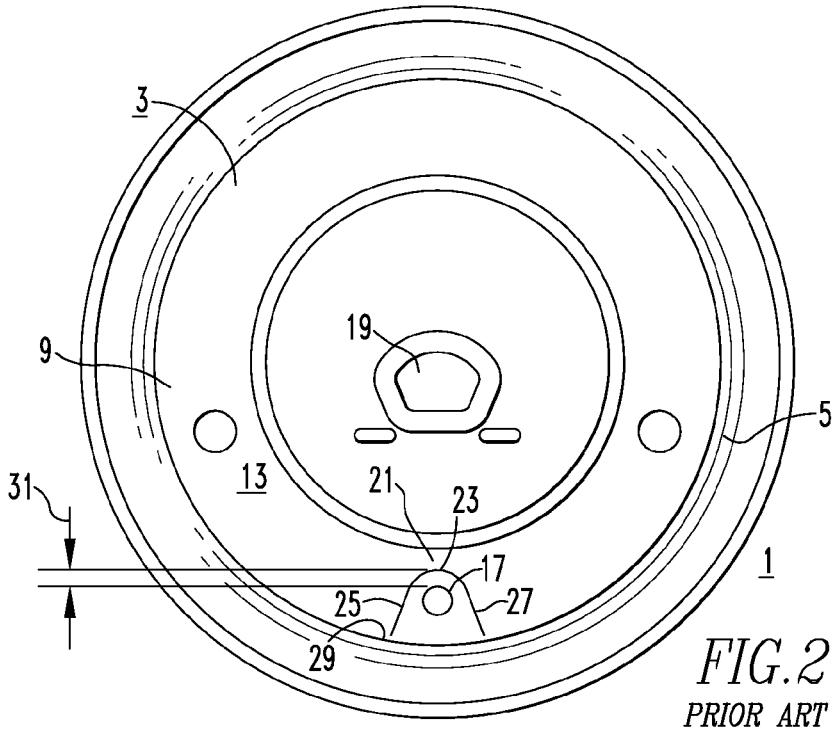
FIG.2 PRIOR ART
FIG. 2 is a bottom plan view of the product side of the can end of FIG. 1, showing a product side back scoreline therefor.
Figure 3B:
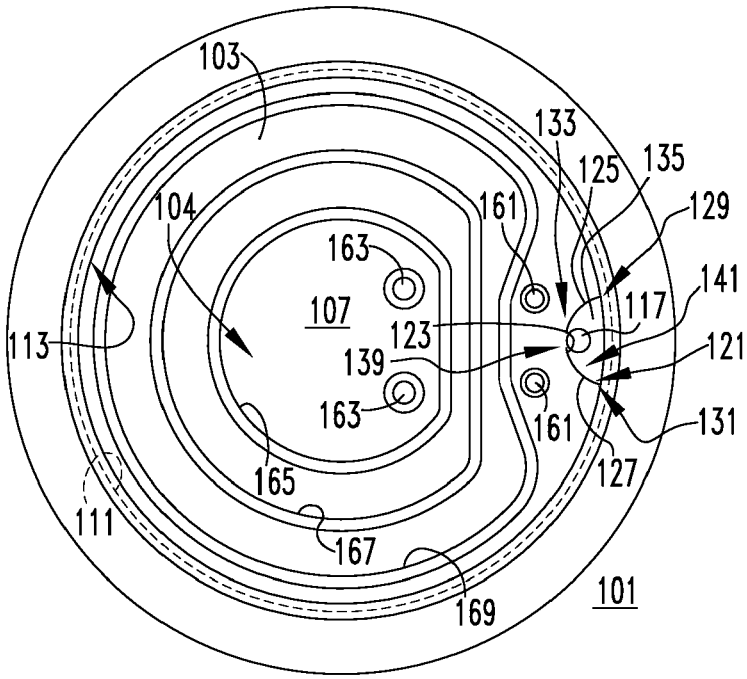
FIG. 3B is a top plan view of the public side of the can end of FIG. 3A, with the pull tab removed to show underlying features.
Figure 3C:
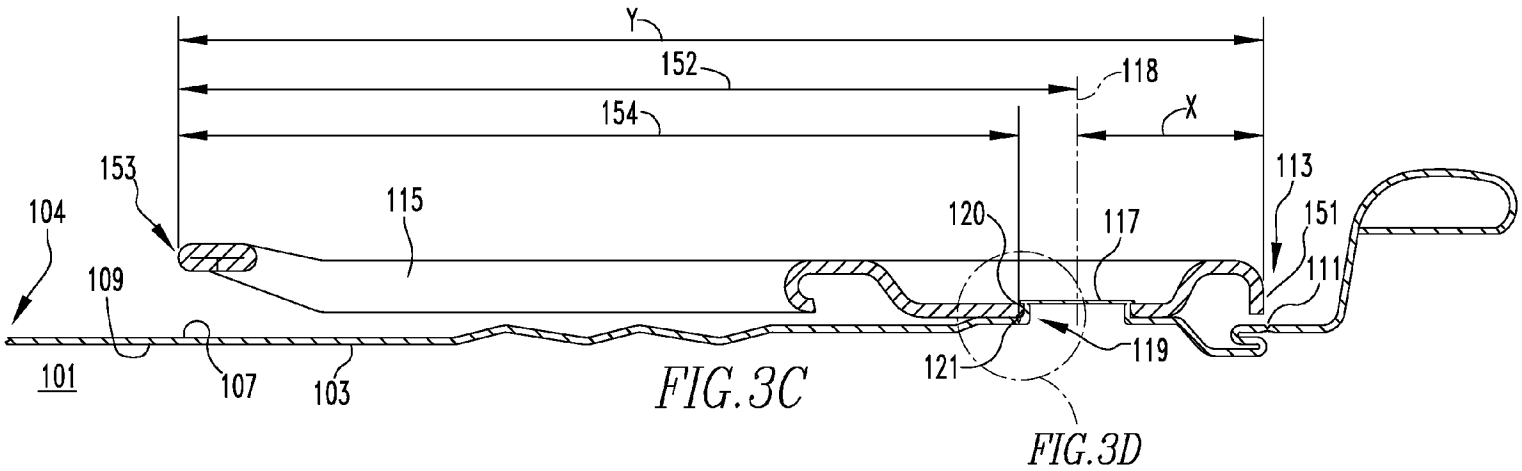
FIG. 3C is a sectional view taken along line 3C-3C of FIG. 3A.
Figure 3D:
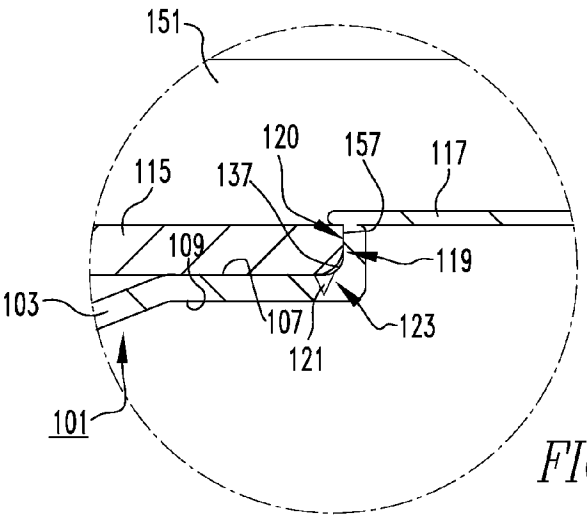
FIG. 3D is an enlarged view of a portion of the can end and rivet base scoreline therefor of FIG. 3C.

Continuing to refer to FIG. 3A, and also to FIGS. 3B-3D, the can end 101 further includes a rivet base scoreline 121 on the public side 107 of the severable panel 103. As best shown in the enlarged view of FIG. 3D, the rivet base scoreline 121 is disposed about 0.025 inch or less from the stem 120 of the rivet 117, and preferably is contiguous with the base 119 of the rivet 117. That it is, the rivet base scoreline 121 is preferably immediately adjacent to, or in an abutting or overlapping relationship with a portion (e.g., without limitation, radius of curvature 137, discussed hereinbelow) of the rivet 117, as opposed to being spaced apart from the rivet a relatively substantial distance (see, for example, the product side back scoreline 21 of FIG. 2, which is spaced relatively substantial distance 31 (e.g., without limitation, at least 0.03 inch) from rivet 17). More specifically, as best shown in FIG. 3D, the base 119 of the example rivet 117 has radius of curvature 137, which forms the intersection between the stem 120 of the rivet 117, and the public side 107 of the can end severable panel 103. An arcuate head portion 123 of the rivet base scoreline 127 is contiguous with such radius of curvature 137.

Among other benefits, by being contiguous with the base 119 of the rivet 117, the rivet base scoreline 121 substantially improves the opening mechanics of the can end 101. Specifically, as will be described in greater detail hereinbelow, it results in decreased opening forces being required to be exerted by the end user, while maintaining a predetermined requisite scoreline residual (e.g., without limitation, about 0.002 inches to about 0.003 inches) so that the can end 101 and, in particular, the scorelines (e.g., without limitation, peripheral scoreline 111; rivet base scoreline 121) are capable of withstanding abuse caused, for example, from shipping, corrosion and other forces to which easy open can ends are commonly exposed.

As shown in FIG. 3B, in which the pull tab 115 (FIG. 3A) has been removed to show the rivet base scoreline 121 in greater detail, in addition to the aforementioned arcuate head portion 123, the rivet base scoreline 121 includes first and second arm portions 125,127 extending from the arcuate head portion 123, and first and second ends 129,131. The arcuate head portion 123 is disposed on an inboard side 133 of the rivet 117, which faces the interior 104 of the severable panel 103. The first and second arm portions 125,127 of the rivet base scoreline 111 generally extend toward an outboard side 135 of the rivet 117, which faces the periphery 113 of the severable panel 103. The arcuate head portion 123 of the rivet base scoreline 121 has a first radius of curvature 139, and the first and second arm portions 125,127 of the rivet base scoreline 121 have a second radius of curvature 141. In the example of FIGS. 3A and 3B (see also rivet base scoreline 121 of FIG. 5, and rivet base scorelines 521 and 621 of FIG. 6), the first radius of curvature 139 of the arcuate head portion 123 is substantially the same as the second radius of curvature 141 of the first and second arm portions 125,127. It will, however, be appreciated that the various portions (e.g., without limitation, arcuate head portion 123; first and second arm portions 125,127; first and second ends 129,131) of the rivet base scoreline 121 may have any known or suitable shape and/or configuration, without departing from the scope of the invention. Specifically, referring to FIGS. 4-6, several EXAMPLES of rivet and rivet base scoreline configurations are shown, and will now be described. It will be appreciated that the following EXAMPLES are provided for illustrative purposes only and are not limiting upon the scope of the invention.

EXAMPLE 1

Figure 4:
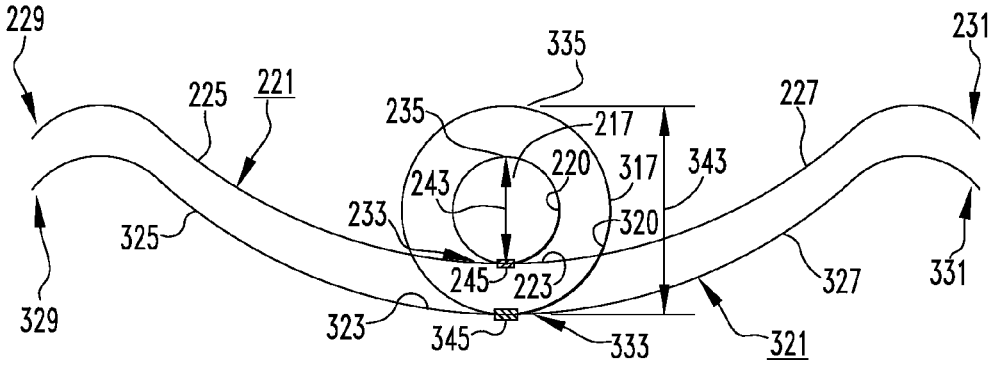
FIGS. 4-6 are simplified top plan views of rivet and rivet base scoreline configurations, in accordance with embodiments of the invention.

As shown in FIG. 4, the rivet 217 preferably has a diameter 243, which is smaller than the rivet of a conventional end (see, for example, rivet 17 of can end 1 of FIG. 1). In one non-limiting embodiment, the rivet diameter 243 is about 0.1875 inch or less. It will, however, be appreciated that the rivet may have any known or suitable diameter. For example and without limitation, rivet 317, which is also shown in FIG. 4, has a diameter 343 of about 0.250 inches.

Continuing to refer to FIG. 4, it will be appreciated that the smaller diameter 243 (e.g., without limitation, about 0.1875 inch or less) of the exemplary rivet 217 advantageously reduces the opening force required to initially sever the rivet base scoreline 221. Specifically, by reducing the rivet diameter 243, the amount of the arcuate head portion 223 of the scoreline 221 that must be severed upon initial actuation of the pull tab 115 to vent the can end 101 (FIG. 3C) is reduced. This segment of the rivet base scoreline 221, which is disposed at the inboard side 233 of the rivet 217, is shown in exaggerated form and is identified by reference number 245 in FIG. 4. By way of comparison, the corresponding segment 345 of the arcuate head portion 323 of rivet base scoreline 321 at the inboard side 333 of the larger (e.g., without limitation, about 0.250 inch) rivet 317 is significantly larger. Thus, the smaller rivet diameter 243 equates to a smaller segment 245 that must be initially severed during opening of the can end 101 (FIG. 3C), as compared to the relatively larger segment 345 associated with the larger diameter rivet 317. Less opening force is required to open the smaller segment 245.

Yet another benefit afforded by the reduced diameter 243 (FIG. 4) of the preferred rivet 217 (FIG. 4; see also rivet 117 of FIG. 3C) will be appreciated with reference to FIG. 3C. Specifically, the rivet 117 has a centerline 118. Dimension, Y (see also FIG. 8), is the overall length of the pull tab 115 measured by the distance between the nose 151 of the pull tab 115 and the opposing end 153 (e.g., lift portion) of the pull tab 115. Dimension, X (see also FIG. 8), is the distance between the rivet centerline 118 and the nose 151 of the pull tab. Reducing the rivet diameter 243 (FIG. 4) correspondingly reduces the dimension, X. As a result, the ratio X/Y is also reduced, thereby improving the opening mechanics of the can end 101. The dimension, X, is preferably about 0.30 inch or less, and the ratio X/Y is preferably about 0.20 or less.

Stated another way, the mechanical levering capabilities of the pull tab 115 are dictated, in large part, by the distance 152 between the rivet centerline 118 and the end 153 (e.g., lift portion) of the pull tab 115, as well as the distance 154 between the end 153 (e.g., lift portion) of the pull tab 115 and the edge (e.g., stem 120) of the rivet 117. Reducing the size (e.g., diameter) of the rivet 117 increases the distance 154 relative to distance 152, thereby adding length to the lever arm of the pull tab 115 and improving its opening mechanics (e.g., decreasing the force required to be exerted on the pull tab 115 to open the can end 101).

EXAMPLE 2

Figure 5:
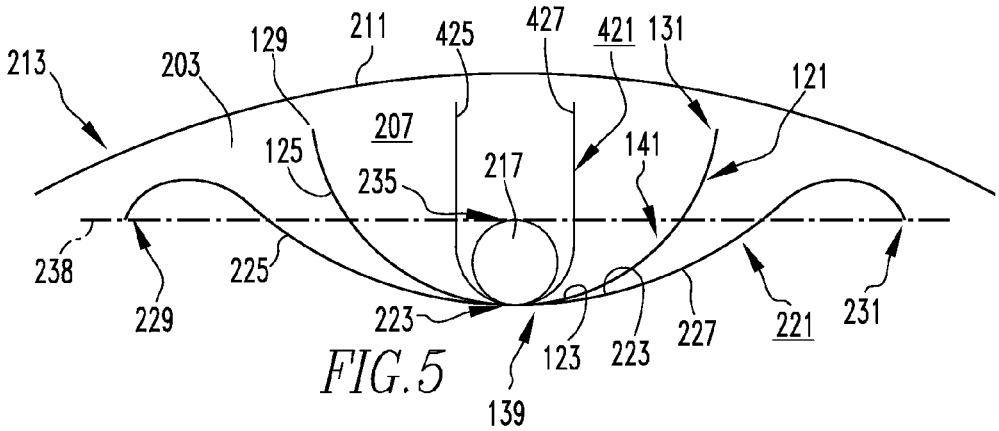
Figure 6:
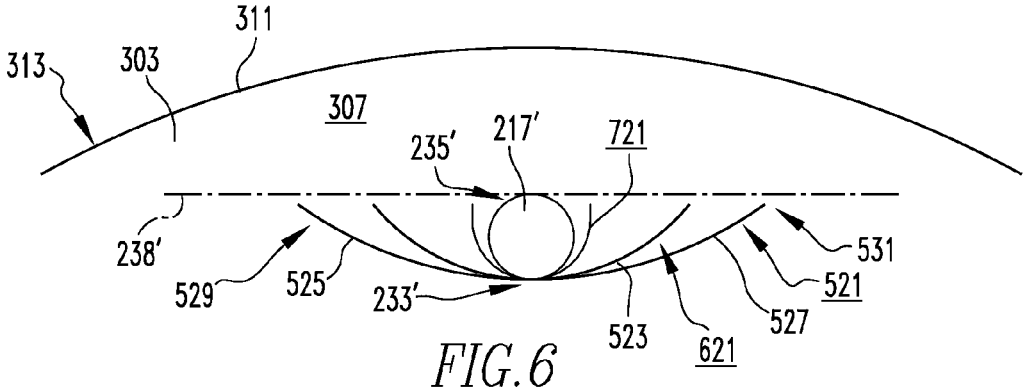

The first and second ends 229,231 of the rivet base scoreline 221 may curve back, away from the periphery 213 (partially shown in FIG. 5) of the severable panel 203, (partially shown in FIG. 5) as shown in FIGS. 4 and 5. See also first and second ends 329,331 of rivet base scoreline 321 of FIG. 4.

EXAMPLE 3

The first and second arm portions 125,127 and/or first and second ends 129,131, respectively, thereof may extend beyond a tangential axis 238, which extends laterally outwardly from, and tangential to, the outboard side 235 of the rivet 217, as shown in FIG. 5. See also the first and second arm portions 425,427 of rivet base scoreline 421.

EXAMPLE 4

The first and second arm portions (e.g., 425,427) of the rivet base scoreline (e.g., 421) can have any known or suitable radius of curvature. For example and without limitation, unlike the first and second arm portions 125,127 of rivet base scoreline 121, previously discussed with respect to FIGS. 3B and 5, the first and second arm portions 425,427 of rivet base scoreline 421 of FIG. 5 are substantially straight.

EXAMPLE 5

The rivet base scoreline (e.g., 521,621,721) may have any known or suitable length. For example, scorelines 521,621, and 721, shown in FIG. 6, extend from the inboard side 233' of rivet 217' toward the outboard side 235' of the rivet 217', but stop short of the tangential axis 238', which extends laterally outwardly from the outboard side 235' of the rivet 217'.

In view of the foregoing EXAMPLES, it will be appreciated that the size and/or configuration of the rivet 117 (FIGS. 3A-3D), 217 (FIGS. 4 and 5), 217' (FIG. 6) and the shape, size and/or configuration of the rivet base scoreline 121 (FIGS. 3A-3D and 5), 221 (FIGS. 4 and 5), 321 (FIG. 4), 421 (FIG. 5), 521 (FIG. 6), 621 (FIG. 6), 721 (FIG. 6) can be arranged to dictate the opening mechanics of the can end 101. For instance, referring again to FIG. 3A, it will be appreciated that, upon actuation of the pull tab 115, the disclosed rivet base scoreline 121 is structured to propagate towards the periphery 113 of the severable panel 103 and, in particular, towards the peripheral scoreline 111 thereof. Specifically, upon actuation (e.g., without limitation, lifting, pivoting and/or pulling (as shown, for example, in FIGS. 9A-9C discussed hereinbelow) of the pull tab 115, the rivet base scoreline 121 severs and propagates toward the peripheral scoreline 111 of the can end 101, thereby defining a bend axis 147. The bend axis 147 extends generally perpendicularly with respect to the longitudinal axis 145 of the pull tab 115, and is disposed between the outboard side 135 of the rivet 117 and the peripheral scoreline 111, proximate to the peripheral scoreline 111, as shown.

Figure 7:
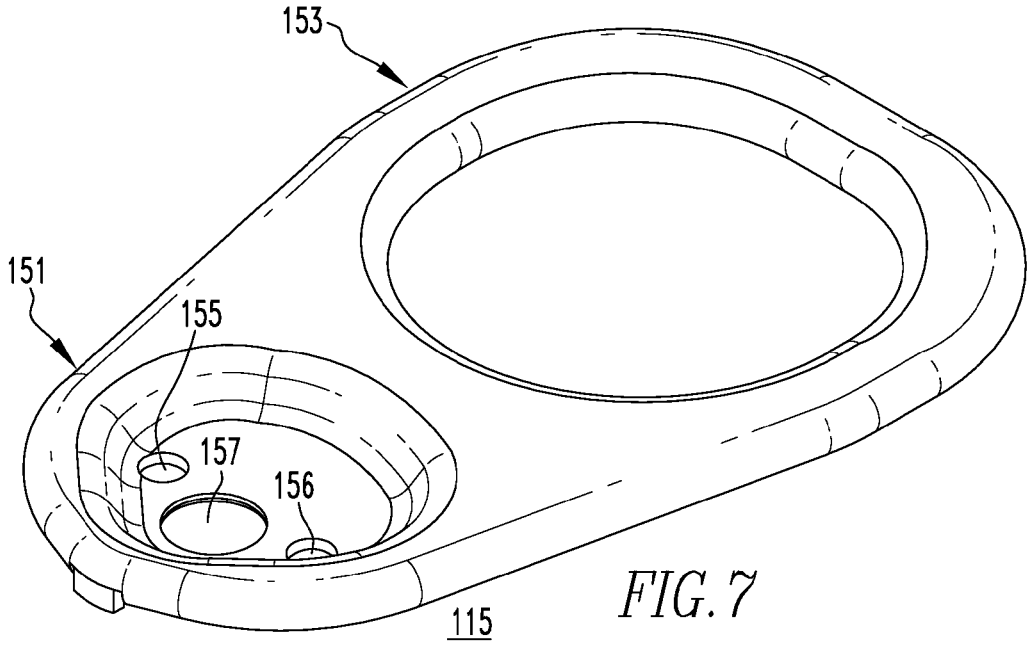
FIG. 7 is an isometric view of a pull tab, in accordance with an embodiment of the invention.
Figure 8:
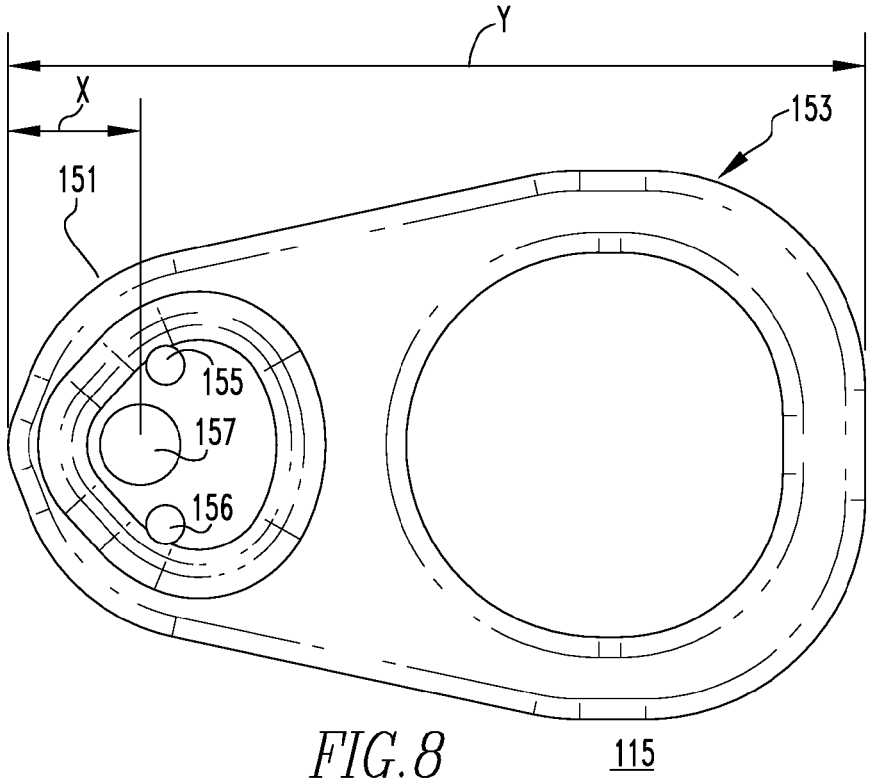
FIG. 8 is a top plan view of the pull tab of FIG. 7.

As shown in FIGS. 7 and 8, the example pull tab 115 includes a nose portion 151 and a lift portion 153 disposed opposite nose portion 151, and being adapted to be lifted by an end user to initiate severing and/or removable of the severable panel 103, as shown in FIG. 9A. The nose portion 151 includes a number of apertures 155,156 and a rivet hole 157. When the pull tab 115 is coupled to the can end 101, the apertures 155,156 overlay at least a portion of the rivet base scoreline 121, which is disposed beneath the pull tab 115, as shown in FIGS. 3A and 11F. In this manner, the apertures 155,156 of the pull tab 115 provide a mechanism (e.g., passageway) for receiving a suitable repair agent (not shown), as defined herein, in order that the repair agent is delivered to and sufficiently covers (e.g., coats; seals) the rivet base scoreline 121 disposed on the public side 107 of the can end severable panel 103 beneath the pull tab 115. It will be appreciated that the pull tab 115 may have any suitable alternative number and/or configuration of apertures (not shown) other than the pair of apertures 155,156, shown and described herein. The rivet hole 157 of the pull tab 115 receives the stem 120 of the rivet 117, as best shown in FIG. 3D. After the pull tab 115 is disposed on the stem 120 of the rivet 117, the rivet 117 can be suitably staked in a generally well known manner to provide the finished rivet 117, shown in FIGS. 3C and 3D, thereby fastening the pull tab 115 to the severable panel 103.

A method of opening the can end 101 is depicted sequentially in FIGS. 9A, 9B, and 9C. Specifically, the pull tab 115 is structured to be lifted (FIG. 9A), pivoted to a substantially inverted position (FIG. 9B), and pulled (FIG. 9C), in order to remove the severable panel 103 from the can 102. The first step of lifting the pull tab 115, shown in FIG. 9A, is commonly referred to as the "pop" stage of the can opening process. The pop stage of opening the exemplary can end 101 begins with a venting operation wherein the pull tab 115 is lifted from the initial substantially horizontal position (see, for example, FIG. 3C) to sever the aforementioned segment 245 (FIG. 4) of the rivet base scoreline (see, for example, rivet base scoreline 221 of FIG. 4; see also rivet base scoreline 121 of FIGS. 9A-9C), thereby venting the can 102. Continuing to lift the pull tab 115 causes the rivet base scoreline 121 to propagate toward the peripheral scoreline 111. Then, the nose portion 151 of the pull tab 115 initially severs the peripheral scoreline 111. The aforementioned bend axis 147 (FIG. 3A) is also formed at this stage. It will be appreciated that the pull tab 115 in accordance with the invention does not require any unique feature (e.g., without limitation, a tongue; a suitable protuberance) extending outwardly from the nose portion 151 thereof, in order to suitably sever the peripheral scoreline 111, although such features could be optionally employed without departing from the scope of the invention.

The second opening stage, shown in FIG. 9B, is commonly referred to as the "flip" stage of opening. The flip stage involves pivoting (e.g., rotating) the pull tab 115 to a substantially inverted position (e.g., without limitation,) about 200 degrees from the original substantially horizontal position), and engaging the rim of the can end 101, as shown. The pull tab 115 can then be further rotated, using the rim of the can end 101 as a fulcrum, in order that the nose portion 151 of the pull tab 115 forces the severable panel 103 away from the can body 102. The severable panel 103 reacts by shearing a substantial portion of the peripheral scoreline 111. For example, in one non-liming embodiment of the invention, at least 40 percent of the peripheral scoreline 111 is severed during the second, or flip, stage of the can end opening process. As shown in Table 1 hereinbelow, this represents about 20 percent greater panel severance (e.g., tear) as compared to a conventional easy open can end (see, for example, can end 1 of FIGS. 1 and 2).

TABLE 1

INITIAL PANEL SHEAR

| | Can End 101 | Standard Aluminum Tab/ Aluminum End | Standard Aluminum Tab/ Steel End | Standard Steel Tab/Steel End |
|---|---|---|---|---|
| Initial Disc Tear (%) | 42.3 | 21.8 | 19.8 | 18.4 |
| Average Tear (%) | 42.3 | | 20.0 | |

The third and final opening stage, which is shown in FIG. 9C, is the pull and/or panel removal stage. Specifically, during this opening stage, the pull tab 115 is pulled away from the can body 102 in the direction of the arrow shown in FIG. 9C. In response, the remaining portion of the peripheral scoreline 111 severs and the severable panel 103 follows the pull tab 115 until it is removed from the can end 101. It will be appreciated that, because of the substantial portion (e.g., without limitation, at least about 40 percent) of the peripheral scoreline 111 that was previously severed during the previous flip stage (FIG. 9B) of the can end opening process, that less force is required to complete removal of the severable panel 103 than would otherwise be required. The improved opening mechanics of the exemplary can end 101 will be further appreciated with reference to Table 2 hereinbelow.

TABLE 2

OPENING FORCES

| | Can End 101 | Standard Aluminum Tab/ Aluminum End | Standard Aluminum Tab/ Steel End | Standard Steel Tab/Steel End |
|---|---|---|---|---|
| Score Pop Force | 3.15 | 2.80 | 4.75 | 4.55 |
| Tab Flip Force | 6.55 | — | — | — |
| Panel Pull Force | 5.25 | 8.35 | 8.80 | 12.65 |

As shown in Table 2, the opening mechanics associated with the exemplary can end 101 are substantially improved as compared to conventional can ends (see, for example, can end 1 of FIGS. 1 and 2). For example, the pop force has been reduced by about one pound, from a standard average force of four pounds to approximately three pounds. The pull force (associated with the final pull stage of opening, shown in FIG. 9C) has been reduced by about 50 percent, from a standard average of ten pounds, to about five pounds. The can end opening stage that requires the greatest force is the flip stage (FIG. 9B), discussed hereinabove. Nonetheless, the force associated with the flip stage for opening can end 101 is about 6.5 pounds, which is still less than the highest force associated with a standard easy open can end. Additionally, the position of the pull tab 115 and the direction of the applied force during the flip stage (FIG. 9B) provides an advantageous mechanical advantage over the opening forces and opening mechanics associated with conventional easy open can ends (see, for example, FIG. 10, discussed hereinbelow).

Figure 10:
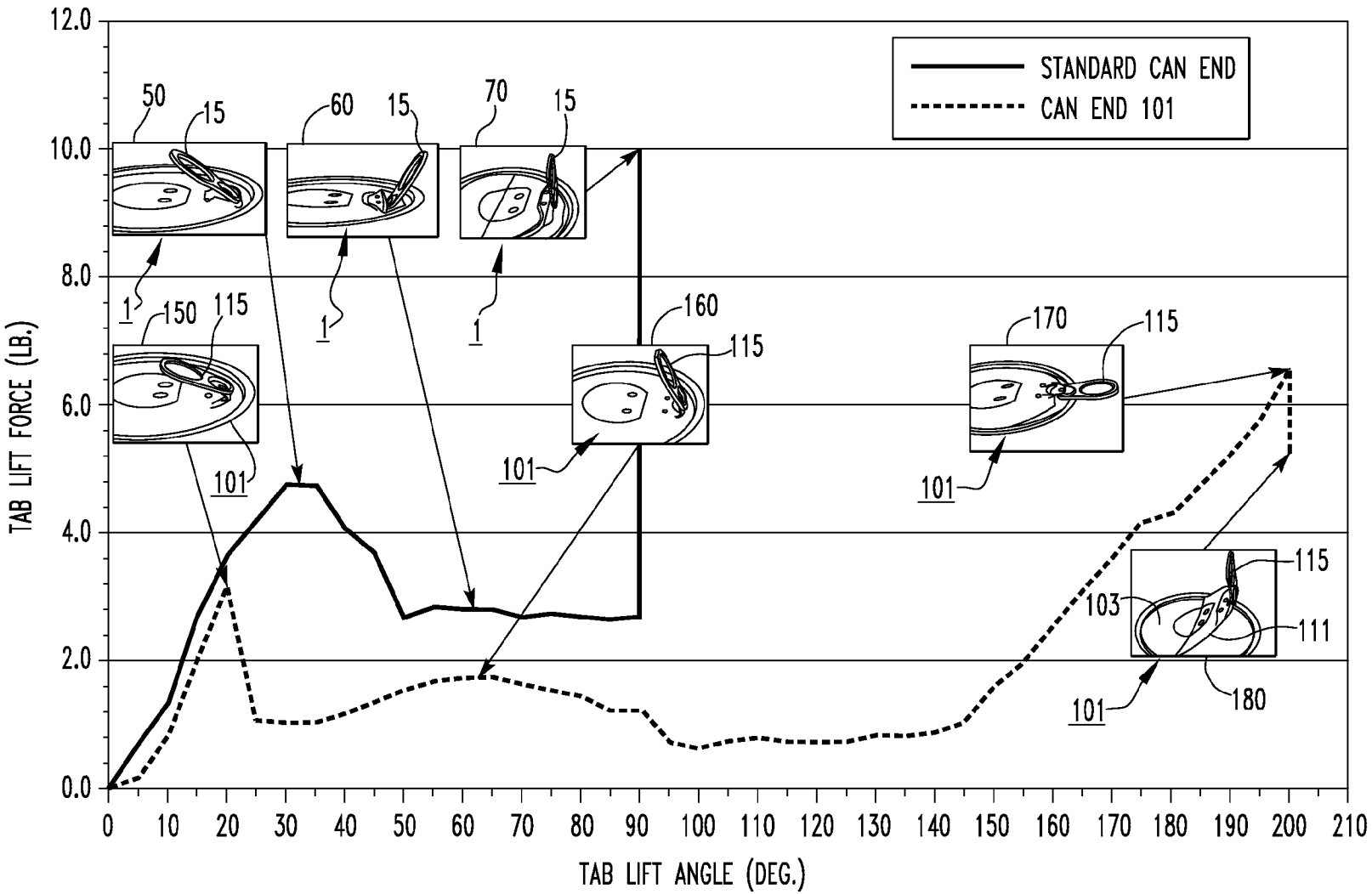
FIG. 10 is a graph comparing the improved opening forces of the can end of the invention to the opening forces of a conventional can end.

The improved opening mechanics of the exemplary can end 101 as compared to a conventional easy open can end (see, for example, can end 1 of FIGS. 1 and 2), will be further appreciated with reference to the comparative graph of FIG. 10. As shown in FIG. 10, the steps for opening the standard can end 1 are sequentially identified by reference numbers 50, 60 and 70. Specifically, reference number 50 identifies the pop stage of opening a standard can end 1, by lifting the pull tab 15. Reference number 60 shows the standard can end 1, fully popped and being flipped, and reference number 70 shows the pull stage of opening the standard can end 1. The forces associated with these opening stages 50,60,70 are identified as specific locations on the solid plot line of FIG. 10. Specifically, the solid plot line depicts the forces applied to the pull tab 15 throughout the entire opening process of the standard can end 1. By way of comparison, the dashed plot line of FIG. 10 illustrates the forces applied to the pull tab 115 of the exemplary can end 101 throughout the entire opening process of the improved can end 101. In particular, reference number 150 refers to the initial vent and pop stage, wherein the pull tab 115 is lifted to sever and propagate the rivet base scoreline 121 to define the bend axis 147 (FIG. 3A), as previously discussed. Reference number 160 correlates to a similar to that depicted by reference number 60 with respect to the standard can end 1. Reference number 170 depicts the flip stage of opening the improved can end 101, and reference number 180 shows the pull stage. By way of one non-limiting example, the pull stage 180 of the exemplary can end 101 involves applying about 5.25 pounds of force to the pull tab 115. Accordingly, it will be appreciated that the forces identified in the graph of FIG. 10 generally correlate with those which are set forth in Table 2 hereinabove.

Figure 11A:
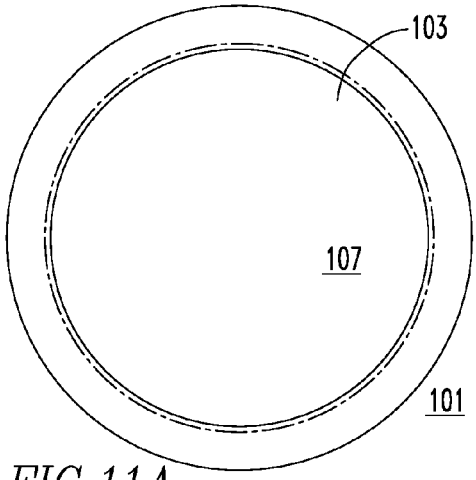
FIGS. 11A-11F are top plan views showing the sequential steps for a method of making a can end, in accordance with an embodiment of the invention.
Figure 11B:
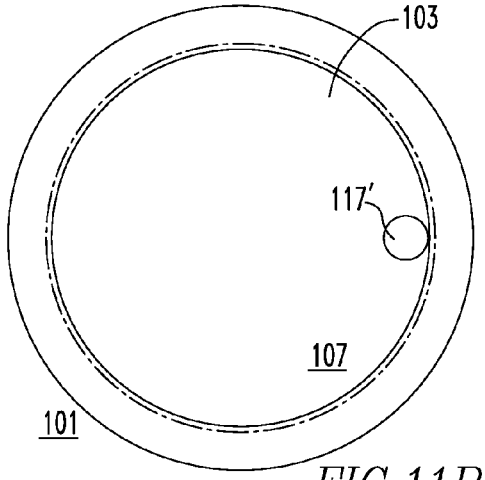
Figure 11C:
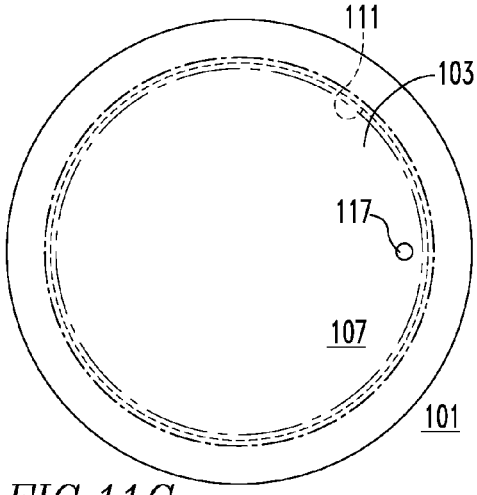
Figure 11D:
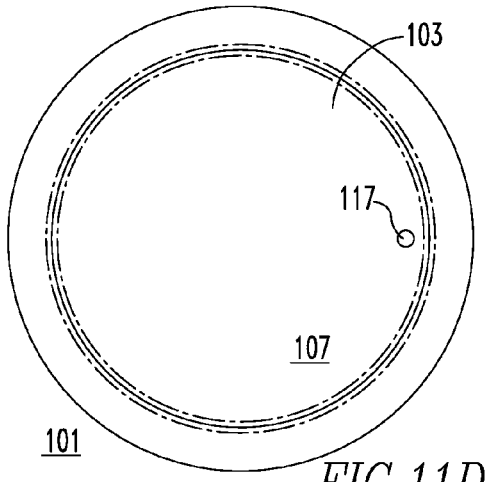
Figure 11E:
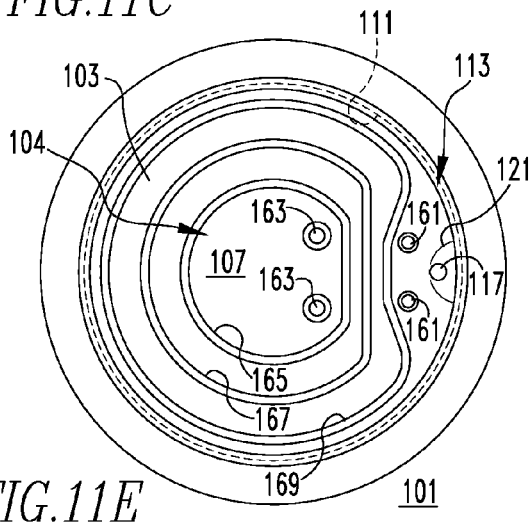
Figure 11F:
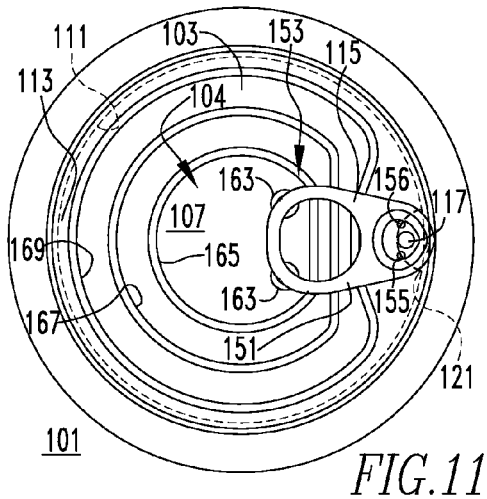

FIGS. 11A-11F show the general steps associated with a method of making a can end 101 in accordance with one non-limiting embodiment of the invention. For example, the can end 101 (e.g., can end shell) may be initially folded in a first step, shown in FIG. 11A. In a subsequent step, depicted in FIG. 11B, the rivet may be initiated as a bubble 117'. FIG. 11C, shows a further rivet forming step in which the peripheral scoreline 111 may also be made. The rivet 117 may be finally formed and the can end 101 (e.g., can end shell) may be further folded in the step depicted in FIG. 11D. Additional features such as, for example and without limitation, a suitable number and configuration of projections 161,163, and beads 165,167,169 may be added to the severable panel 103 in a subsequent step, shown in FIG. 11E. The rivet base scoreline 121 in accordance with the invention, may also be formed at this step. Finally, the pull tab 115 can be attached to the rivet 117, and the rivet 117 can be staked, as shown in FIG. 11F.

It will be appreciated that the method depicted in FIGS. 11A-11F generally involves the conversion of a can end shell into the desired can end 101 end product. It will also be appreciated that the method may include additional and/or different steps, and that such steps can be performed in a different sequence than that which is illustrated, all without departing from the scope of the invention. Additionally, as previously discussed, the can end 101 may undergo additional processing. For example and without limitation, the aforementioned repair agent (not shown) may be applied to the can end 101 to suitably seal the rivet base scoreline 121. In this regard, the exemplary pull tab 115 and, in particular, the apertures 155,156 in the nose portion 151 thereof, facilitate delivery of the repair agent to the rivet base scoreline 121 to ensure that the rivet base scoreline 121 is effectively coated (e.g., sealed).

Accordingly, the disclosed can end 101 and associated method of making the same, provide a unique rivet base scoreline 121 that substantially improves the opening mechanics of the can end 101. Additionally, the unique pull tab 115 of the can end 101 enables the rivet base scoreline 121 to be efficiently and effectively coated, as necessary, despite the fact that it is disposed on the public side 107 of the can end severable panel 103, at least partially beneath the pull tab 115.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A can end structured to be affixed to a can body, the can end comprising:

a severable panel having a periphery, an interior, a product side structured to face toward the can body when the can end is affixed to the can body, and a public side structured to face away from the can body when the can end is affixed to the can body;

a peripheral scoreline defining the periphery of the severable panel;

an opening mechanism coupled to the severable panel, the opening mechanism being actuatable to sever the peripheral scoreline;

a rivet coupling the opening mechanism to the severable panel, the rivet having a base disposed at the severable panel, a stem extending outwardly from the severable panel, an inboard side facing the interior of the severable panel, and an outboard side facing the periphery of the severable panel; and a rivet base scoreline in the public side of the severable panel, the rivet base scoreline being disposed about 0.025 inch or less from the stem of the rivet, wherein said rivet base scoreline includes an arcuate head portion substantially disposed on the inboard side of the rivet, the arcuate head portion having a first radius of curvature, wherein the rivet base scoreline further includes first and second arcuate arm portions having a second radius of curvature and first and second ends, the radius of curvature of each of the arcuate arm portions extending from the arcuate head portion to the corresponding one of the first and second ends, the first radius of curvature of the arcuate head portion is the same as the second radius of curvature of the first and second arm portions, and wherein the first and second ends of the first and second arcuate arm portions of the rivet base scoreline generally extend toward the outboard side of the rivet.

2. The can end of claim 1 wherein the base of the rivet has a radius of curvature; wherein the radius of curvature forms an intersection between the stem of the rivet and the public side of the severable panel; and wherein the arcuate head portion of the rivet base scoreline is contiguous with the radius of curvature of the base of the rivet.

3. The can end of claim 1 wherein the first and second arm portions of the rivet base scoreline extend beyond the outboard side of the rivet toward the periphery of the severable panel.

4. The can end of claim 1 wherein the opening mechanism has a longitudinal axis; wherein, upon actuation of the opening mechanism, the rivet base scoreline is structured to propagate toward the peripheral scoreline of the can end, thereby defining a bend axis; wherein the bend axis extends generally perpendicularly with respect to the longitudinal axis of the opening mechanism; and wherein the bend axis is disposed proximate to the peripheral scoreline.

5. The can end of claim 1 wherein the opening mechanism is structured to be lifted, pivoted to a substantially inverted position, and pulled, in order to remove the severable panel; wherein, responsive to being lifted, the opening mechanism is structured to initially sever the peripheral scoreline; and wherein, responsive to being pivoted to the substantially inverted position, the opening mechanism is structured to sever at least 40 percent of the peripheral scoreline.

6. The can end of claim 1 wherein the opening mechanism is a pull tab; wherein the pull tab includes a nose portion and a lift portion disposed opposite the nose portion; wherein the nose portion of the pull tab overlays at least a portion of the rivet base scoreline; and wherein the nose portion of the pull tab includes a number of apertures structured to be aligned with corresponding portions of the rivet base scoreline thereunder.

7. The can end of claim 1 wherein the severable panel includes a number of projections protruding from the severable panel; and wherein the number of projections support the opening mechanism and resist undesired rotation of the opening mechanism relative to the rivet.

8. The can end of claim 1 wherein the opening mechanism is a pull tab; wherein the pull tab includes a nose and a lift portion disposed opposite and distal from the nose; wherein the stem of the rivet has a diameter and a centerline; wherein the pull tab has a dimension, X, measured by the distance between the centerline of the rivet and the nose of the pull tab, and a dimension, Y, measured by the total length of the pull tab between the nose of the pull tab and the lift portion of the pull tab; and wherein the ratio X/Y is about 0.20 or less.

9. The can end of claim 8 wherein the diameter of the stem of the rivet is about 0.1875 inch or less.

* * * * *

UNITED STATES PATENT AND TRADEMARK OFFICE

CERTIFICATE OF CORRECTION

PATENT NO. : 8,109,405 B2
APPLICATION NO. : 12/137958
DATED : February 7, 2012
INVENTOR(S) : Gregory H. Butcher et al.

It is certified that error appears in the above-identified patent and that said Letters Patent is hereby corrected as shown below:

Column 2, line 18, “experience,” should read --experienced,--.
Column 5, line 25, “spaced relatively” should read --spaced a relatively--.
Column 5, line 28, “has radius” should read --has a radius--.
Column 8, line 49, “non-liming” should read --non-limiting--.
Column 10, line 7, “to that” should read --stage to that--.

Signed and Sealed this
Twenty-fourth Day of July, 2012

David J. Kappos

David J. Kappos
*Director of the United States Patent and Trademark Office*